United States Patent [19]

Rupe et al.

[11] 4,116,851

[45] Sep. 26, 1978

[54] THICKENED BLEACH COMPOSITIONS FOR TREATING HARD-TO-REMOVE SOILS

[75] Inventors: Lewis Allen Rupe; Lyle Brown Tuthill; John William Leikhim, all of Cincinnati, Ohio

[73] Assignee: The Procter & Gamble Company, Cincinnati, Ohio

[21] Appl. No.: 808,016

[22] Filed: Jun. 20, 1977

[51] Int. Cl.[2] ..... C11D 7/54; C11D 7/56

[52] U.S. Cl. ..... 252/103; 252/95; 252/135; 252/187 H; 8/108 A; 134/2; 134/39; 134/40

[58] Field of Search ..... 252/99, 103, 187 H, 252/316, 317; 424/149; 134/2, 4, 38, 39, 40

[56] References Cited

U.S. PATENT DOCUMENTS

| | | | |
|---|---|---|---|
| 3,558,496 | 1/1971 | Zmoda | 252/99 X |
| 3,684,722 | 8/1972 | Hynam et al. | 252/99 X |
| 3,929,661 | 12/1975 | Nakagawa et al. | 252/103 |
| 3,985,668 | 10/1976 | Hartman | 252/99 |
| 4,005,027 | 1/1977 | Hartman | 252/103 |
| 4,011,176 | 3/1977 | Marsan et al. | 252/99 |
| 4,029,591 | 6/1977 | Ohbu et al. | 252/103 X |

*Primary Examiner*—Mayer Weinblatt
*Attorney, Agent, or Firm*—Edmund F. Gebhardt; Richard C. Witte; Thomas H. O'Flaherty

[57] ABSTRACT

Highly alkaline thickened aqueous liquid hypohalite compositions containing either mineral oil, water insoluble saturated fatty acid esters, water insoluble ethers, and mixtures thereof, preferably thickened with a clay, preferably thixotropic, and containing an alkali metal silicate which can be used in a process for cleaning kitchen utensils having baked-on soils comprising the steps of treating a soiled utensil surface with the thickened alkaline hypohalite composition and then covering the treated soiled utensil surface with an excess of water at a temperature of more than about 100° F. The compositions containing clay, an alkali metal silicate and the mineral oil, water insoluble ester and ethers, etc. are particularly stable, provide good corrosion protection to metals, are milder to skin than the same alkaline hypohalite compositions without the mineral oil, etc. Preferred compositions containing the silicate and saturated fatty acid esters do not leave a residue of dried product which is difficult to remove.

13 Claims, No Drawings

THICKENED BLEACH COMPOSITIONS FOR TREATING HARD-TO-REMOVE SOILS

BACKGROUND OF THE INVENTION

This invention relates to compositions for pretreating kitchen housewares, especially pots, pans, dishes, etc. which are soiled with hard-to-remove food soils and a process for treating said soils. Many of these housewares are made of aluminum which is particularly subject to attack by hypohalite and alkalinity.

Thickened hypochlorite compositions are known having been taught in U.S. Pat. Nos. 3,843,548; 3,558,496; 3,684,722; and 4,005,027. However, none of the above patents discloses applicants' particular process or applicants' preferred alkaline, hypohalite compositions containing a clay and/or alkali metal silicate and mineral oil, water insoluble fatty acid ester, water insoluble ether and mixtures thereof.

The use of bleaches in cleaning housewares is known, having been taught in U.S. Pat. Nos. 3,928,065; 3,708,429; 3,058,917; and 3,671,440.

Other patents disclosing bleaching compositions containing clays or silicas include U.S. Pat. Nos. 3,634,273; 1,600,845; 3,393,153; and 3,697,431.

All of the above-mentioned patents are incorporated herein by reference. However, none of the above references teach either applicants' process or applicants' preferred stable compositions.

SUMMARY OF THE INVENTION

The invention provides a preferred alkaline aqueous liquid hypohalite composition having a pH of from about 9 to about 13, preferably containing from about ¼% to about 20% of a clay thickening and corrosion protection agent, and containing from about ½% to about 9% of an alkali metal silicate having an $SiO_2$:$M_2O$ ratio greater than about 1 wherein M is selected from the group consisting of sodium and potassium, and from about ¼% to about 20% of a safety, dispersing, and/or cleaning improver selected from the group consisting of water insoluble mineral oil containing more than about 20 carbon atoms, saturated fatty acid ester, dialkyl ether and mixtures thereof having a freezing point below about 15° C. and a vapor point above about 100° C.; the hypohalite concentration giving from about ½% to about 10% available halogen; and said composition having a viscosity of from about 100 CPS to about 1,000,000 CPS.

The invention also provides a process for cleaning housewares soiled with hard-to-remove food soil comprising the steps of (1) applying a thickened alkaline aqueous liquid hypohalite composition having a pH of from about 9 to about 13; a hypohalite concentration of from about 1% to about 10%; from about ¼% to about 20% of a safety, dispensing, and/or cleaning improver selected from the group consisting of water insoluble mineral oil containing more than about 20 carbon atoms, saturated fatty acid ester, dialkyl ethers, and mixtures thereof having a freezing point below about 15° C. and a vapor point above about 100° C.; a viscosity of from about 100 CPS to about 1,000,000 CPS to the hard-to-remove soil and thereafter in step (2) covering said treated soil with an excess of water at a temperature of more than about 100° F.

DETAILED DESCRIPTION OF THE INVENTION

The Bleach Component

The hypohalite bleach component is present in the compositions of this invention in an amount to provide available halogen, e.g., chlorine, ranging from about ½% to about 10%, preferably from about 1% to about 6% and most preferably from about 2% to about 5%.

The bleach component can be any compound capable of liberating hypohalite such as hypochlorite and/or hypobromite on contact with aqueous media. Examples include the alkali metal hypochlorites or hypobromites or alkaline earth metal hypochlorites or hypobromites. Examples of such useful bleaches are sodium hypochlorite, potassium hypochlorite, lithium hypochlorite, calcium hypochlorite and magnesium hypochlorite. Sodium hypochlorite is highly desirable because of its ready availability. However, lithium and magnesium hypochlorites are desirably stable.

Particular examples of organic bleaching agents include the dry, particulate heterocyclic N-bromo and N-chloro imides such as trichlorocyanuric, tribromocyanuric acid, dibromo- and dichlorocyanuric acid, the salts thereof with water-solubilizing cations such as potassium and sodium and mixtures thereof. Particular compounds are potassium dichloroisocyanurate and trichloroisocyanuric acids.

Other N-bromo and N-chloro imides may also be used, such as N-brominated and N-chlorinated succinimide, malonimide phthalimide and naphthalimide. Other compounds include the hydantoins, such as 1,3-dibromo and 1,3-dichloro-5,5-dimethylhydantoin; N-monochloro-5,5-dimethylhydantoin, methylene-bis(N-bromo-5,5,-dimethylhydantoin); 1,3-dichloro,5,methyl-5-N-amylhydantoin, and the like. Other useful hypohalite liberating agents comprise tribromomelamine and trichloromelamine.

Brominated and chlorinated trisodium phosphates formed by the reaction of the corresponding sodium hypohalite solution with trisodium phosphate (and water as necessary) are also useful.

Other bleaching agents are capable of liberating hypochlorite as well as hypobromite such as, for example, the N-brominated, N'-chlorinated heterocyclic imides, as, for example, the N-bromo, N'-chlorocyanuric acids and salts thereof, e.g., N-monobromo-N, N-dichlorocyanuric acid, N-monobromo-N-monochlorocyanuric acid, sodium N-monobromo-N-monochlorocyanurate, potassium-N-monobromo-N-monochlorocyanurate; and the N-brominated, N-chlorinated hydantoins, e.g., N-bromo-N-chloro-5,5-dimethylhydantoin and N-bromo-N-chloro-5-ethyl-5-methyl hydantoin.

The Clay Component

The compositions contain a clay thickening agent which may be either naturally occurring or synthetic. A preferred synthetic clay is the one disclosed in U.S. Pat No. 3,843,548, incorporated herein by reference. Naturally occurring clays include smectite and attapulgite clays.

The clay materials which function in the instant composition as thickening and corrosion protection agents can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonoids) and attapulgites (or palygorskites).

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$and $Mg_3(Si_2O_5)(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atom substitution by iron and magnesium can occur within the crystal lattice of the smectites, while metal cations such as $Na^+$, $Ca^{++}$, as well as $H^+$, can be copresent in the water of hydration to provide electrical neutrality. Although the presence of iron in such clay material is preferably avoided to minimize chemical interaction between clay and bleach, such cation substitutions in general are immaterial to the use of the clays herein since the desirable physical properties of the clay are not substantially altered thereby.

The layered expandable aluminosilicate smectite clays useful herein are further characterized by a dioctahedral crystal lattice, whereas the expandable magnesium silicate clays have a trioctahedral crystal lattice.

The smectite clays used in the compositions herein are all commercially available. Such clays include, for example, montmorillonite (bentonite), volchonskoite, nontronite, beidellite, hectorite, saponite, sauconite and vermiculite. The clays herein are available under commercial names such as "Fooler Clay" (clay found in a relatively thin vein above the main bentonite or montmorillonite veins in the Black Hills) and various trade names such as Thixogel No. 1 and Gelwhite GP from Georgia Kaolin Company, Elizabeth, New Jersey (both montmorillonites); Volclay BC and Volclay No. 325, from American Colloid Company, Skokie, Illinois; Black Hills Bentonite BH 450, from International Minerals and Chemicals; Veegum Pro and Veegum F, from R. T. Vanderbilt (both hectorites); Barasym NAS-100, Barasym NAH-100, Barasym SMM 200, and Barasym LIH-200, all synthetic hectorites and saponites marketed by Baroid Division, NL, Industries, Inc.

Smectite clays are preferred for use in the instant invention. Montmorillonite, hectorite and saponite are the preferred smectites. Gelwhite GP, Barasym NAS-100 and Barasym NAH-100 are the preferred montmorillonites, hectorites and saponites.

A second type of expandable clay material useful in the instant invention is classified geologically as attapulgite (palygorskite). Attapulgites are magnesium-rich clays having principles of superposition of tetrahedral and octahedral unit cell elements different from the smectites. An idealized composition of the attapulgite unit cell is given as: $(OH_2)_4(OH)_2Mg_5Si_8O_{20}.4H_2O$.

A typical attapulgite analyses yields 55.02% $SiO_2$; 10.24% $Al_2O_3$; 3.53% $Fe_2O_3$; 10.45% MgO; 0.47% $K_2O$; 9.73% $H_2O$ removed at 150° C.; 10.13% $H_2O$ removed at higher temperatures.

Like the smectites, attapulgite clays are commercially available. For example, such clays are marketed under the tradename Attagel, i.e. Attagel 40, Attagel 50 and Attagel 150 from Engelhard Minerals & Chemicals Corporation.

Particularly preferred from the colloid-forming clay component in certain embodiments of the instant composition are mixtures of smectite and attapulgite clays. In general, such mixed clay compositions exhibit increased and prolonged fluidity upon application of shear stress but are still adequately thickened solutions at times when flow is not desired. Clay mixtures in a smectite/attapulgite weight ratio of from 5:1 to 1:5 are preferred. Ratios of from 2:1 to 1:2 are more preferred. A ratio of about 1:1 is most preferred.

As noted above, the clays employed in the compositions of the present invention contain cationic counter ions such as protons, sodium ions, potassium ions, calcium ions, magnesium ions and the like. It is customary to distinguish between clays on the basis of one cation which is predominately or exclusively absorbed. For example, a sodium clay is one in which the absorbed cation is predominately sodium. Such absorbed cations can become involved in exchange reactions with cations present in aqueous solutions. It is preferred that the present compositions contain up to about 12% or preferably up to about 8% potassium ions since they improve the viscosity increasing characteristics of the clay. Preferably at least 1%, more preferably at least 2% of the potassium ions are present.

Specific preferred clays are disclosed in U.S. Pat. Nos. 3,993,573 and 4,005,027, incorporated herein by reference. These materials are preferred for thickening. The amount of clay will normally be from about ¼% to about 20%, preferably from about 1% to about 12%.

Other Thickening Agents

Other thickening agents which are useful in combination with the clay include those disclosed in U.S. Pat. No. 3,393,153 incorporated herein by reference, including colloidal silica having a mean particle diameter ranging from about 0.01 micron to about 0.05 micron and particulate polymers such as polystyrene, oxidized polystyrene having an acid number of from 20 to about 40, sulfonated polystyrene having an acid number of from about 10 to about 30, polyethylene, oxidized polyethylene having an acid number of from about 10 to about 30; sulfonated polyethylene having an acid number of from about 5 to about 25; polypropylene, oxidized polypropylene having an acid number of from about 10 to about 30 and sulfonated polypropylene having an acid number of from about 5 to about 25, all of said particulate polymers having mean particle diameters ranging from about 0.01 micron to about 30 microns. Other examples include copolymers of styrene with monomers such as maleic anhydride, nitrilonitrile, methacrylic acid and lower alkyl esters of methacrylic acid. Other materials include copolymers of styrene with methyl or ethyl acrylate, methyl or ethyl maleate, vinyl acetate, acrylic, maleic or fumaric acids and mixtures thereof. The mole ratio of ester and/or acid to styrene being in the range from about 4 to about 40 styrene units per ester and/or acid unit. The latter materials having a mean particle diameter range of from about 0.05 micron to about 1 micron and molecular weights ranging from about 500,000 to about 2,000,000.

Other bleach stable thickening agents can be used, including carboxypolymethylene, etc.

The viscosity of the composition is from about 100 CPS to about 1,000,000 CPS, preferably from about 500 CPS to about 50,000 CPS. Most preferably the composition is thixotropic.

The Silicate Component

The compositions of this invention contain from about ½% to about 9%, preferably from about 1% to about 3% of an alkali metal silicate, preferably sodium or potassium silicates, having a ratio of silicon dioxide to alkali metal oxide of greater than about 1, preferably greater than about 1.5, and most preferably greater than about 2. These silicates serve as a source of alkalinity and primarily to improve the corrosion protection of the composition. The clays also contribute to corrosion protection and human safety, including skin mildness and ingestion safety when used with the silicate. Accordingly, when other thickening agents are used, it is desirable to add at least about 1% clay to improve corrosion protection. Non-expandable clays that do not thicken can also be used as corrosion protection agents.

The Safety, Dispensing and Cleaning Improver Component

It has been found that water-insoluble mineral oils, saturated fatty acid esters and dialkyl ethers and mixtures thereof, at levels of from about ½% to about 20%, preferably from about 1% to about 10%, improve the compositions and processes of this invention in several ways. Most importantly, these materials at a more preferred level of from about 2% to about 7% improve the safety of the compositions when they touch skin and mucoid membranes. Also, the preferred fatty acid esters dramatically improve the removal of dried spots of the compositions which contain the aforementioned silicates. All of the materials slow the drying rate of spots of the compositions, thereby assisting in their removal. Finally, all of the ingredients improve the ability of the compositions to be dispensed by spraying.

The preferred water-insoluble materials are saturated fatty acid esters in which the fatty acid and the fatty alcohol each contain an alkyl group containing from 1 to 18, preferably one being from about 12 to about 18, carbon atoms with the total number of carbon atoms being sufficient to give water insolubility and the proper solidification and vaporization temperatures. The total number of carbon atoms is preferably from about 13 to about 22, most preferably from about 15 to about 20. Examples include methyl, ethyl, isopropyl, and isobutyl laurates, myristates, palmitates and stearates and lauryl, myristyl, palmityl and stearyl acetates, propionates, and butyrates. Mixtures thereof are desirable.

Other desirable water-insoluble materials are mineral oils containing carbon chains in excess of about 20 carbon atoms, most preferably from about 20 to about 30. Examples include high viscosity (Saybolt viscosity at 100° F. of about 335 to 350) heavy oils having a specific gravity of from about 0.86–0.91 sp. gr. at 60° F.; low viscosity (Saybolt viscosity at 100° F. of about 125 to 135), light oil having a specific gravity of from about 0.82 to about 0.88 at 60° F.; and mixtures thereof.

Still other useful water-insoluble materials are dialkyl ethers in which each alkyl can contain from 1 to about 13 carbon atoms so long as the solidification and vaporization requirements are met. The total number of carbon atoms in a dialkyl ether should be from about 7 to about 14, preferably from about 10 to about 12. Examples include methyl/n-propyl, methyl/t-butyl, ethyl/n amyl and di-isopropyl ethers, and mixtures thereof.

All of the above materials are desirably used at a leve of from about ¼% to about 20%, preferably from abou 1% to about 10% and most preferably from about 2% to about 7%.

Optional Components

In addition to the above essential ingredients, it may be desirable to include hypochlorite bleach stable per fumes including those of the type disclosed in U.S. Pat No. 3,876,551; British Pat. No. 886,084; and U.S. Pat No. 3,684,722, incorporated herein by reference.

Bleach stable dyes, coloring agents, pigments opacifiers, etc. can be added in minor amounts. The compositions can also contain a hypochlorite bleach stable surface active agent including those of U.S. Pat No. 3,684,722, incorporated herein by reference, which can also act as a thickening agent and those contained in German patent application No. 2,458,100; U.S. Pat Nos. 3,876,551; 3,697,431; and 4,005,027; South African patent application No. 70/5875, etc., all of said patents and applications being incorporated herein by reference.

Abrasives can be included in amounts up to about 60% by weight, preferably from about 8% to about 32% by weight. Such insoluble materials have particle size diameters ranging from about 1 to about 250 microns and specific gravities of from about 0.5 to about 5.0. It is preferred that the diameter of the particles range from about 2 microns to about 60 microns and that their specific gravity is sufficiently low that they can easily be suspended in the thixotropic liquid compositions of the instant invention in their quiescent state.

The abrasives which can be utilized include, but are not limited to, quartz, pumice, pumicite, titanium dioxide ($TiO_2$), silica sand, calcium carbonate, zirconium silicate, diatomaceous earth, whiting and feldspar. Silica sand is the preferred abrasive for use in the instant compositions. For dishwashing purposes, abrasives are normally undesirable and not preferred.

Bleach Stable Surfactants

The compositions can contain up to about 10%, preferably from about 0.25% to about 2% by weight of bleach stable surfactant.

The surfactant selected for use in the present compositions must be stable against chemical decomposition and oxidation by the strong active chlorine bleaching agent also essentially present. Accordingly, surfactant materials of the instant invention must contain no functionalities (such as unsaturation, some aromatic structures, amide, aldehydic, methyl keto, or hydroxy groups) which are susceptible to oxidation by the hypochlorite species found in the present compositions. Thus many of the commonly employed surfactant materials of the prior art, i.e., olefin sulfonates, alkyl glycery ether sulfonates, and ethoxylated nonionic surfactants which terminate in a hydroxyl group, are to be avoided in the compositions of the instant invention.

Bleach-stable surfactants which are especially resistant to hypochlorite oxidation fall into two main groups. One such class of bleach-stable surfactants are the water-soluble alkyl sulfates containing from about 8 to 18 carbon atoms in the alkyl group. Alkyl sulfates are the water-soluble salts of sulfated fatty alcohols. They are produced from natural or synthetic fatty alcohol containing from about 8 to 18 carbon atoms. Natura fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable surfactant materials operable in the instant invention are the water-soluble betaine surfactants. These materials have the general formula:

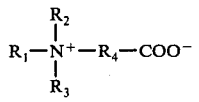

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and are hence not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanotate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Other desirable bleach stable surfactants are the alkyl phosphonates, taught in the copending U.S. patent application of Ronald L. Jacobsen, Ser. No. 728,579, filed Oct. 1, 1976, incorporated herein by reference.

Builders

Some compositions can also contain agents for controlling hardness ions including alkali metal, e.g., sodium or potassium, carbonates, organic polyphosphonate and/or polycarboxylate chelators (e.g., mellitates, polyacrylates, oxylates, tartrates, malonates, adipates, gluconates, and citrates), tripolyphosphates, pyrophosphates, orthophosphates, etc. These materials act as detergency improvers. Desirably the composition will contain little or no phosphorus materials. The materials for controlling hardness ions can be present in amounts up to about 15%, preferably in amounts up to about 10%, most preferably from about 2% to about 6%.

The compositions are adjusted to their proper alkaline level by the addition of an alkali metal, e.g., sodium or potassium hydroxide or carbonate. Preferably a hydroxide is added. The final pH should be from about 9 to about 13, preferably from about 10 to about 12.5.

Solvents

The remainder of the composition will normally be water, but small amounts of organic solvents such as $C_1$-$C_5$ chlorinated hydrocarbons, such as methylene chloride, can also be added in amounts up to about 10%, preferably from about 1% to about 6%.

Process For Cleaning

The process of this invention is based on the discovery that superior cleaning can be accomplished by applying the thickened, preferably thixotropic, highly alkaline bleach compositions of this invention to baked-on, hard-to-remove soil and then covering the treated soil with an excess of water, e.g., by filling the pot or pan with water or putting the utensil with water. Surprisingly if the water is at ambient temperature, i.e., 70° F., the advantage is minimal. However, if the water is hotter than 100° F., preferably hotter than 120° F., the amount of work needed to remove the soil is drastically reduced. The temperature is normally lower than boiling, e.g., less than about 210° F.

An additional advantage of the compositions of this invention is the suppression of suds in an aromatic dishwasher when the treated kitchen utensils are added to the dishwasher.

An additional advantage of the compositions of this invention is the suppression of suds in an automatic dishwasher when the treated kitchen utensils are added to the dishwasher.

All percentages, parts and ratios herein are by weight unless otherwise specified.

EXAMPLE I

This Example demonstrates the surprising results obtained with this invention. The compositions in the following tests contain 3% sodium hypochlorite, 3% of a sodium silicate having an $SiO_2$:$Na_2O$ ratio of about 3.2, 5% potassium carbonate, and 3.5% of a montmorillonite clay (Gelwhite GP) and the indicated water-insoluble components at a level of 5% with the balance being water. This product is thixotropic and has a viscosity of about 2000 CPS and a pH of about 11.5.

In the first test to demonstrate the effect of the indicated water insoluble components, ten duplicate samples with spray pumps were prepared for each formula. Each sample for each formula was sprayed every other day and graded for sprayability. (Sprayability is defined as spray pattern uniformity.) After 15 days, a weighted average score of all grades of each formula as well as a theoretically perfect score was calculated. By using the numerical spread between the control score and a perfect score as a base value, a percent improvement sprayability between the control and the formulas containing the indicated water insoluble ingredients were calculated.

| | |
|---|---|
| Control | 0% |
| Decane | 16% |
| Isopropyl myristate | 33% |
| Heavy mineral oil (as defined hereinbefore) | 37% |

As can be seen, the compositions of this invention are superior in sprayability as compared to the same compositions without a water-insoluble component present or with a lower chain hydrocarbon present.

In the second test, the present of weight loss of the various compositions was determined as a meausre of the drying rate which is an indication of how soom spots will be dry and therefore hard to remove.

| | 2 hr. | 4 hr. | 24 hr. |
|---|---|---|---|
| Control | 21.2 | 42.8 | 78.6 |
| Heavy mineral oil | 17.5 | 35.4 | 69.2 |
| Isopropyl myristate | 16.1 | 30.9 | 68.0 |

The above shows the superiority of the compositions of this invention, and especially the fatty acid esters.

In the third test, dried spots of the various formulas were removed using a Gardner testing machine and the "work", expressed in arbitrary units for comparison purposes, is a measure of the work required to remove the spot to a point where it looks clean while still wet. The "visibility" grade is then a measure of the appearance of the "cleaned" spot after drying. The numbers vary from 1 = very, very slightly visible to 4 = medium visibility and 5 = heavy deposit visible.

| | Work | Visibility |
|---|---|---|
| Control | 91 | 4 |
| Heavy mineral oil | 79 | 4 |
| Isopropyl myristate | 38 | 1 |

As can be seen from the above, the compositions of the invention improve the removal with the fatty acid acid ester being unobviously superior.

EXAMPLE II

| | |
|---|---|
| Colloidal silica (Aerosil COK 84) (Degussa, Inc.) | 4.0% |
| Gelwhite GP | 0.5% |
| $SiO_2$:$Na_2O$ r = 2.5 | 3.0% |
| NaOCl | 3.0% |
| Methyl/decyl ether | 4.0% |
| Water (pH adjusted to 10.5 with NaOH and $H_2SO_4$ as required) | Balance |
| Viscous - Thixotropic; Reduces work index; Provides aluminum protection. | |

EXAMPLE III

| | |
|---|---|
| Sodium carboxypolymethylene (Carpopol 941) (B. F. Goodrich) | 2.0% |
| Kaolin (Kaopaque 10) (Georgia Kaolin) | 1.0% |
| $SiO_2$:$Na_2O$ r = 2.0 | 5.0% |
| KOCl | 3.5% |
| Butyl octanoate | 7.0% |
| Water (pH adjusted to 11.0 with $H_2SO_4$ and NAOH as required) | Balance |
| Viscous - Thixotropic; Reduces work index; Provides aluminum protection. | |

EXAMPLE IV

| | |
|---|---|
| Bentonite treated with a quaternary ammonium compound (Bentone 34) (N. L. Industries) | 6.0% |
| $SiO_2$:$K_2O$ r = 2.5 | 5.0% |
| $K_2CO_3$ | 8.0% |
| NaOCl | 2.0% |
| Lauryl acetate | 5.0% |
| Water (pH adjusted as required with $H_2SO_4$ and KOH to 12) | Balance |
| Viscous - Thixotropic; Reduces work index; Provides aluminum protection. | |

EXAMPLE V

| | |
|---|---|
| Gelwhite GP | 8.0% |
| $SiO_2$:$Na_2O$ r = 3.2 | 3.0% |
| $K_2CO_3$ | 5.0% |
| KDCC (Potassium dichloro cyanurate) | 5.0% |
| Isopropyl palmitate | 5.0% |
| Water (pH adjusted to 11.5 with KOH and $H_2SO_4$ as required) | Balance |
| Viscous - Thixotropic; Reduces work index; Provides aluminum protection. | |

EXAMPLE VI

| | |
|---|---|
| Gelwhite GP | 4.0% |
| $SiO_2$:$Na_2O$ r = 3.2 | 3.0% |
| $K_2CO_3$ | 5.0% |
| NaOCl | 3.0% |
| Methyl, n-hexyl ether | 4.0% |
| Sodium $C_{14-16}$ paraffin sulfonate | 1.0% |
| Water (pH adjusted to 11.5 with $H_2SO_4$ and NaOH as required | Balance |
| Viscous - Thixotropic; Reduces work index; Provides aluminum protection. | |

EXAMPLE VII

| | |
|---|---|
| Bentone 34 | 6.0% |
| $SiO_2$:$Na_2O$ r = 3.2 | 5.0% |
| $K_2CO_3$ | 7.0% |
| NaOCl | 3.0% |
| Ethyl, n-amyl ether | 4.0% |
| Methylene chloride | 6.0% |
| Water (pH adjusted to 11.8 with NaOH and $H_2SO_4$ as required) | Balance |
| Viscous - Thixotropic; Reduces work index; Provides aluminum protection. | |

EXAMPLE VIII

| | |
|---|---|
| Carbopol 941 | 2.0% |
| Bentone 34 | 0.5% |
| $SiO_2$:$Na_2O$ r = 2.5 | 3.0% |
| NaDCC | 5.0% |
| Butyl laurate | 4.0% |
| Na Citrate | 8.0% |
| Water (pH adjusted to 11.0 with NaOH and $H_2SO_4$ as required) | Balance |
| Viscous - Non-thixotropic; Reduces work index; Provides aluminum protection. | |

EXAMPLE IX

| | |
|---|---|
| Gelwhite GP | 4.0% |
| $SiO_2$:$Na_2O$ r = 3.2 | 3.0% |
| $K_2CO_3$ | 5.0% |
| NaOCl | 3.0% |
| Isopropyl, t-butyl ether | 6.0% |
| Potassium orthophosphate | 3.0% |
| NaOCl | 3.0% |

-continued

| | |
|---|---|
| Mineral oil (avg. of 30 carbon atoms) | 5.0% |
| Potassium randomly phosphonated octadecene | 1.0% |
| Water (pH adjusted to 11.5 with $H_2SO_4$ and KOH as required) | Balance |
| Viscous - Thixotropic; Reduces work index; Provides aluminum protection. | |

EXAMPLE XIII

| | |
|---|---|
| Gelwhite GP | 4.0% |
| $SiO_2$:$Na_2O$ r - 3.2 | 3.0% |
| $K_2CO_3$ | 5.0% |
| Sodium para-toluene sulfoschloramine | 10.0% |
| Hexyl hexanoate | 3.0% |
| Sodium $C_{14-16}$ paraffin sulfonate | 1.0% |
| Water (pH adjusted to 11.5 with $H_2SO_4$ and NaOH as required) | Balance |
| Viscous - Thixotropic; Reduces work index; Provides aluminum protection. | |

What is claimed is:

1. An alkaline, aqueous, liquid composition having a pH of from about 9 to about 13, consisting essentially of:

(a) from about ¼% to about 20% of a clay thickening and corrosion protection agent selected from the group consisting of smectite and attapulgite clays and mixtures thereof, (b) from about ½% to about 9% of an alkali metal silicate having an $SiO_2$:$M_2O$ ratio greater than about 1 wherein M is selected from the group consisting of sodium and potassium, (c) from about ¼% to about 20% of a safety, dispensing, and/or cleaning improver selected from the group consisting of water-insoluble mineral oil compounds containing carbon chains in excess of about 20 carbon atoms and having a specific gravity of at least about 0.82, water-insoluble saturated fatty acid esters containing from about 13 to about 22 carbon atoms, water-insoluble dialkyl ethers wherein each alkyl contains from 1 to about 13 carbon atoms and the total carbon atoms is from about 7 to about 14, and mixtures thereof having a freezing point below about 15° C. and a vapor point above about 100° C.

(d) a hypohalite liberating bleach component selected from the group consisting of alkali metal and alkaline earth metal hypochlorites and hypobromites, brominated trisodium phosphate, chlorinated trisodium phosphate, heterocyclic N-bromo and N-chloro imides and mixtures thereof, said hypohalite liberating bleach component being at a concentration to provide an available halogen level of from about ½% to about 10%, (e) from 0% to about 10% of a bleach stable surfactant selected from the group consisting of alkyl sulfate salts containing from about 8 to about 18 carbon atoms in the alkyl group and water-soluble betaine surfactants having the general formula:

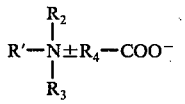

wherein $R_1$ is an alkyl group containing from about 8 to 18 carbon atoms, $R_2$ and $R_3$ are each alkyl groups containing from 1 to about 4 carbon atoms and $R_4$ is an alkylene group selected from the group consisting of methylene, propylene, butylene and pentylene, (f) from 0% to about 15% of detergency improvers selected from the group consisting of alkali metal carbonates, polyphosphonates, polycarboxylates, phosphates and mixtures thereof, (g) from 0% to about 10% methylene chloride, and (h) from 0% to about 60% of an abrasive selected from the group consisting of quartz, pumice, pumicite, titanium dioxide, silica sand, calcium carbonate, zirconium silicate, diatomaceous earth, whiting, feldspar and mixtures thereof, said abrasive having particle size diameters of from about 1 to about 250 microns and specific gravities of from about 0.5 to about 5.0, and (i) the remainder water, said composition having a viscosity of from about 100 CPS to about 1,000,000 CPS.

2. The composition of claim 1 wherein said improver is a mineral oil containing an average of from about 20 to about 30 carbon atoms.

3. The composition of claim 1 wherein said improver is a dialkyl ether containing from about 10 to about 12 carbon atoms.

4. The composition of claim 1 having an available halogen level of from about 1% to about 6%.

5. The composition of claim 1 containing from about 1% to about 12% of a clay thickening and corrosion protection agent which is selected from the group consisting of montmorillonite, volchonskoite, nontrionite, hectorite, saponite, sauconite, vermiculite and mixtures thereof.

6. The composition of claim 1 wherein the alkali metal silicate has an $SiO_2$:$M_2O$ ratio greater than about 2 and is present in an amount from about 1% to about 3%.

7. The composition of claim 6 containing from about 1% to about 12% of a clay thickening agent which is selected from the group consisting of montmorillonite, volchonskonite, nontrionite, hectorite, saponite, sauconite, vermiculite and mixtures thereof.

8. The composition of claim 1 wherein said safety, dispensing and/or cleaning improver is present in an amount from about 1% to about 10%.

9. The composition of claim 8 wherein said improver is a saturated fatty acid ester.

10. The composition of claim 9 wherein said fatty acid ester contains from about 15 to about 20 carbon atoms.

11. The composition of claim 9 wherein said improver is an isopropyl ester of a $C_{12}$ to $C_{18}$ fatty acid.

12. The process for cleaning hard-to-remove soils from kitchen utensils in which the composition of claim 1 is applied to said soils and said soils are then covered with an excess of water having a temperature of more than about 100° F.

13. The process of claim 12 wherein the hypohalite is hypochlorite at a concentration to give available chlorine level of from about 1% to about 6%, the viscosity of the hypochlorite composition is between about 500 CPS and about 50,000 CPS, said composition is thixotropic, the pH of said composition is from about 10 to about 12.5, said composition contains an alkali metal silicate in an amount from about 1% to about 3%, said alkali metal silicate having a silicon dioxide to alkali metal oxide ratio of more than about 2 and said safety, dispensing and/or cleaning improver is a fatty acid ester.

* * * * *

UNITED STATES PATENT AND TRADEMARK OFFICE

CERTIFICATE OF CORRECTION

PATENT NO. : 4,116,851

DATED : September 26, 1978

INVENTOR(S) : Lewis Allen Rupe, Lyle Brown Tuthill, John William Leikhim

It is certified that error appears in the above-identified patent and that said Letters Patent are hereby corrected as shown below:

Column 5, line 27, "1/2%" -- should be -- 1/4% --.

Column 8, line 27, "utensil with water" -- should be -- utensil into water --.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*